US005899685A

United States Patent [19]

Thigpen

[11] Patent Number: 5,899,685

[45] Date of Patent: May 4, 1999

[54] REMOTE LIGHTED WICK EXTINGUISHER

[76] Inventor: Harold D. Thigpen, 2685 NE. 15th St., Popano Beach, Fla. 33062

[21] Appl. No.: 08/960,372

[22] Filed: Oct. 29, 1997

Related U.S. Application Data

[60] Provisional application No. 60/029,197, Oct. 30, 1996.

[51] Int. Cl.[6] ..... F23Q 25/00

[52] U.S. Cl. ..... 431/144; 431/145; 431/289

[58] Field of Search ..... 431/144, 145, 431/289

[56] References Cited

U.S. PATENT DOCUMENTS

| | | |
|---|---|---|
| D. 310,127 | 8/1990 | Johnson . |
| 1,120,043 | 12/1914 | Erickson et al. . |
| 1,289,874 | 12/1918 | Mutu . |
| 2,158,744 | 5/1939 | Cormier . |
| 2,499,118 | 2/1950 | Sipes . |
| 2,741,904 | 4/1956 | Stelle et al. . |
| 2,792,699 | 5/1957 | Lamm . |
| 3,204,433 | 9/1965 | Bureau . |
| 3,905,746 | 9/1975 | Patrikios . |
| 3,985,492 | 10/1976 | Nunemaker . |
| 4,138,211 | 2/1979 | Kampfer et al. . |
| 4,810,185 | 3/1989 | Nakamura et al. . |
| 4,887,960 | 12/1989 | Stewart et al. . |
| 5,126,731 | 6/1992 | Cromer, Jr. et al. . |

FOREIGN PATENT DOCUMENTS

| | | |
|---|---|---|
| 1370467 | 10/1974 | United Kingdom . |
| 1433875 | 4/1976 | United Kingdom . |

*Primary Examiner*—Carroll B. Dority
*Attorney, Agent, or Firm*—Richard C. Litman

[57] ABSTRACT

A remote lighted wick extinguisher that uses a movement of air to extinguish the flame of a lighted wick. Energy is sent from a transmitter to a remote receiver. The receiver actuates a circuit, such as a mono-stable multivibrator or one shot producing a pulse. The pulse, having sufficient amplitude and duration, actuates a transducer, similar to a speaker. The pulse causes a diaphragm of the transducer to displace, thus displacing a volume of air. When the transducer is disposed in close proximity as the lighted wick, the displaced air is able to extinguish the flame of the lighted wick. Thus, a user is able to extinguish the flame of a lighted wick lamp remotely from a distance.

9 Claims, 2 Drawing Sheets

REMOTE LIGHTED WICK EXTINGUISHER

CROSS-REFERENCE TO RELATED APPLICATION

This application claims the benefit of U.S. Provisional Patent Application Ser. No. 60/029,197, filed Oct. 30, 1996.

BACKGROUND OF THE INVENTION

1. Field of the Invention

The present invention relates generally to lighted wick extinguishers. More specifically, the invention relates to a remote lighted wick extinguisher that extinguishes the flame through a movement of air.

2. Description of the Related Art

Lighted wicks are used for a great number of purposes; such as candlelit meals, religious symbolisms, alternative and emergency lighting, etc. In all instances, the flame of a lighted wick must be extinguished. In general, the flame is extinguished by snuffing or blowing by manual exertion. Such procedures are usually inconvenient, particularly for the physically challenged individual. Many devices have been promulgated for controlling devices remotely.

For example, U.S. Pat. No. 1,289,874, issued to Mutu on Dec. 31, 1918; U.S. Pat. No. 2,158,744, issued to Cormier on May 16, 1939; U.S. Pat. No. 3,905,746, issued to Patrikios on Sep. 16, 1975; and U.S. Pat. No. 2,792,699, issued to Lamm on May 21, 1957, each describes a lighted wick extinguisher that uses forced air movement to extinguish the flame but fail to disclose a lighted wick extinguisher using a diaphragm to produce air movement for extinguishing the flame.

Moreover, U.S. Pat. No. 2,499,118, issued to Sipes on Apr. 9, 1949; U.S. Pat. No. 4,138,211, issued to Kampfer et al. on Feb. 6, 1979; U.S. Pat. No. 3,985,492, issued to Nunemaker on Oct. 12, 1976; U.S. Pat. No. 2,741,904, issued to Stelle et al. on Apr. 17, 1956; U.S. Pat. No. 1,120,043, issued to Erickson on Dec. 8, 1914; U.S. Pat. No. 4,810,185, issued to Nakamura et al. on Mar. 7, 1989; U.S. Pat. No. 3,204,433, issued to Bureau on Sep. 7, 1965; U.S. Pat. No. 4,887,960, issued to Stewart et al. on Dec. 19, 1989; U.S. Pat. No. Des. 310,127, issued to Johnson on Aug. 21, 1990; United Kingdom Patent Document No. 1,370,467 published on Oct. 16, 1974; and United Kingdom Patent Document No. 1,433,875 published on Oct. 1974, each describes a lighted wick extinguisher, but fails to disclose a lighted wick extinguisher that uses forced air movement to extinguish the lighted wick.

U.S. Pat. No. 5,126,731, issued to Cromer, Jr. et al. on Jun 30, 1992, discloses a remote control device, but fails to disclose a remote lighted wick extinguisher.

None of the above inventions and patents, taken either singly or in combination, is seen to describe the instant invention as claimed.

SUMMARY OF THE INVENTION

Accordingly, a need for a remote lighted wick extinguisher exists. It is apparent to those skilled in the art that such a device provides a convenience to most individuals and is a necessity to those such persons who have, for the most part, been hampered with physical impairments, preventing them from carrying out the most minuscule tasks. The present invention assists those individuals with the opportunity to enjoy alternative lighting and be able to extinguish the flame without any undue exertion. A further purview of the invention allows variations interior decoration for establishing a "mood" or ambience for romantic engagements, religious rituals, fantasy activities, etc.

The present invention is a remote lighted wick extinguisher that uses a movement of air to extinguish the flame of a lighted wick. Energy is sent from a transmitter to a remote receiver. The receiver actuates a circuit, such as a mono-stable multivibrator or one shot producing a pulse. The pulse, having sufficient amplitude and duration, actuates a transducer, such as a speaker. In addition, the receiver also actuates a tonal generator which in turn causes the speaker to emulate the sound of a person blowing. The pulse causes a diaphragm of the transducer to displace, thus displacing a volume of air. When the transducer is disposed in close proximity as the lighted wick, the displaced air is able to extinguish the flame of the lighted wick. Thus, a user is able to extinguish the flame of a lighted wick lamp remotely from a distance. Alternatively, the receiver also includes an independent timer which generates a pulse after a predetermined period of time for actuating the transducer to extinguish the flame, thereby minimizing the possibility of disaster due to forgetting to extinguish the flame.

Accordingly, it is a principal object of the invention to provide a lighted wick extinguisher remotely operated.

It is another object of the invention to provide a remotely operated lighted wick extinguisher that uses air movement to extinguish the lighted wick.

It is a further object of the invention to provide a lighted wick extinguisher that uses the diaphragm to provide air movement for extinguishing the lighted wick.

Still another object of the invention is to provide a lighted wick extinguisher using a remote transmitting and receiving scheme for producing air movement.

It is yet another object of the invention to provide a transmitter and remote receiver for generating a pulse to actuate a diaphragm, producing air movement.

It is still yet another object of the invention to provide a remotely operated lighted wick extinguisher including a sound generator.

It is yet a further object of the invention to provide a lighted wick extinguisher having a single multifunctional transmitter.

Still yet another object of the invention is to provide a lighted wick extinguisher having one or more independent receivers, each responsive to a single multifunctional transmitter.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

Similar reference characters denote corresponding features consistently throughout the attached drawings.

DETAILED DESCRIPTION OF THE PREFERRED EMBODIMENT

Figure 1:
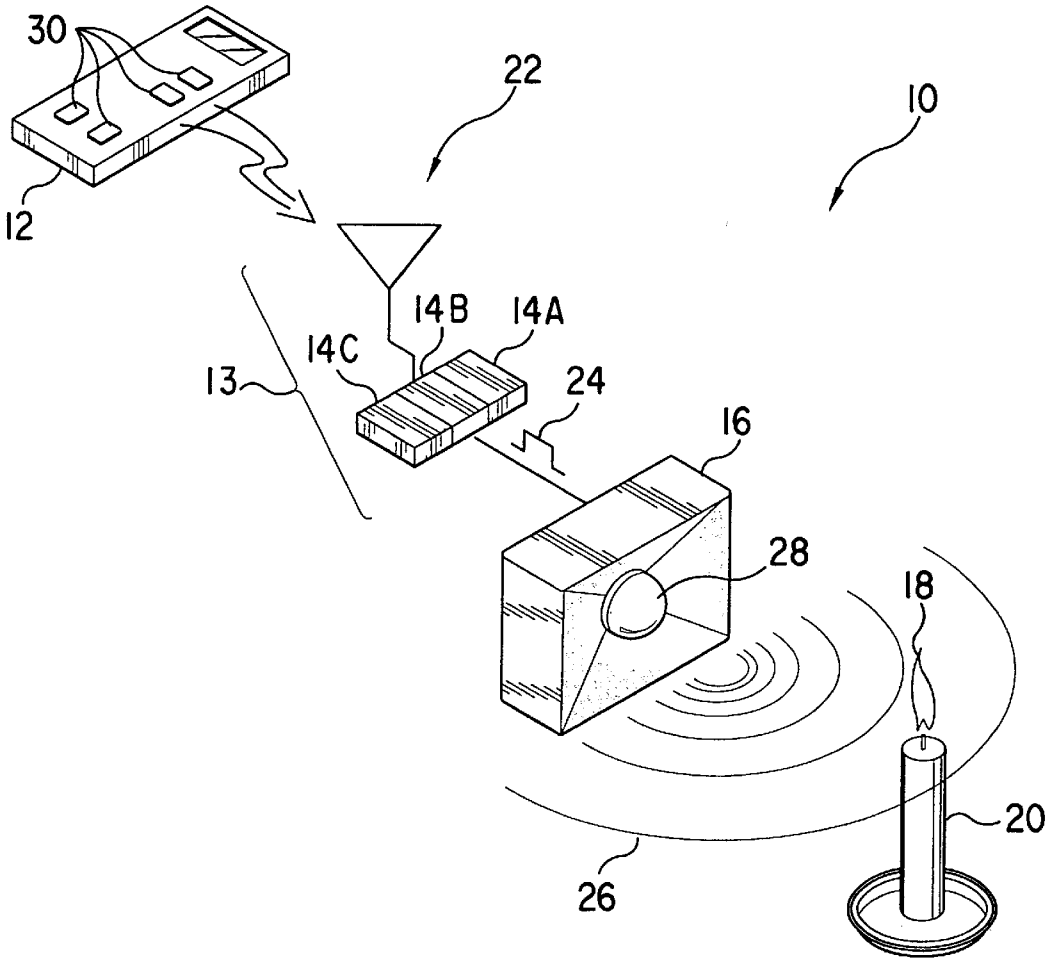
FIG. 1 is an environmental view of the preferred embodiment.

The present invention is shown in FIG. 1 as a remote lighted wick extinguisher 10. The remote lighted wick extinguisher 10, includes a transmitting device 12, a receiving device 13, and a transducer 16. Transmitting device 12 emits radiant energy in response to a user actuating switch controls 30. Receiving device 13 receives the emitted energy and converts the energy into an electrical pulse 24. The electrical pulse 24 is delivered from the receiving device 13 to a transducer 16. Finally, the transducer 16 converts the electrical pulse 24 into a burst of wind 26, thus extinguishing a flame 18 of lighted wick lamp 20.

The transmitting device 12 is a remote control transmitter operating in a standard manner. The transmitting device 12 has a plurality of control switches 30 for operation. During operation, a user points the emitting end of the transmitting device in the general direction of the appliance (namely the receiving device 13 of the instant disclosure) and depresses any one or combination of the control switches 30. The transmitting device 12 thus emits an energy signal in the form of RF (or radio frequency), laser, pulsed beam, IR-LED (infra-red light emitting diode), etc. Alternative transmission sources are also useable, such as acoustic transmitters, etc. The form of energy transmitted is only dependent on production costs and resource availability.

The receiving device 13 includes a receiving antenna 22 and a receiver/converter circuit 14A, a tone generator 14B, and a timing circuit 14C. The receiving antenna 22 is complementary to the transmitting device 12, in that the receiving antenna 22 specifically responds to the type of energy radiated by the transmitting device 12. For instance, in the preferred embodiment, an IR-LED transmitting source is utilized, thus an IR photo detector would be the appropriate type component for the receiving antenna 22.

Once radiated energy is received by the receiving antenna 22, an electrical signal is communicated from the receiving antenna 22 to the receiver/converter circuit 14A. The receiver/converter circuit 14A responds to the electrical signal and generates an electrical pulse 24. The receiver/converter circuit 14A consists, in the preferred embodiment, of mono-stable multivibrator or oneshot. The energy received by receiving antenna 22 communicates an electrical signal to the receiver/converter circuit 14A. This actuates the mono-stable multivibrator or one-shot. The multivibrator or one-shot produces the electrical pulse 24. The electrical pulse 24 has a characteristic electrical signature, peculiar to the preferred embodiment. For example, an electrical pulse burst having an amplitude on the order of five (5) volts and a duration on the order of $10^{-3}$ seconds is generally preferred.

The receiving antenna 22 also communicates the electrical signal to the tone generator 14B. The tone generator 14B produces a signal, also shown as electrical pulse 24, for causing the diaphragm 28 to audibly produce a 'wisp', 'puff' or similar sound. The sound enhances the ambience provided by the lighted wick lamp 20 during a romantic moment, for example. The tone generator 14B is a conventional circuit capable of emulating a human issuing a burst of air for extinguishing the flame 18 of the lighted wick lamp 20.

Additionally, the timing circuit 14C provides an independent signal, also represented as electrical pulse 24, activating the transducer 16 to extinguish the flame 18 of the lighted wick lamp 20. The timing circuit 14C is set in a conventional manner using the transmitting device 12. The timing circuit 14C functions, for instance, by counting up or down through a time window. At the completion of the time window, the flame 18 is extinguished automatically. This permits the user, with confidence, to use the lighted wick lamp 20 safely. The timing circuit 14C prevents the flame 18 to burn longer than a preset time, thus avoiding possible dangers and catastrophes.

Upon generation of the electrical pulse 24, a transducer 16 is used to transform the electrical pulse 24 into a burst of wind 26.

The transducer 16 has a moveable diaphragm 28 responsive to an electromechanical element (not shown). The transducer 16 operates in a similar fashion as that of an audio speaker. The electrical pulse 24 actuates the electromechanical element which thus causes the diaphragm 28 to be displaced from a rest position. This displacement lasts for the duration of the electrical pulse 24. Once the electrical pulse 24 is dispersed, the resiliency of the diaphragm 28 returns the diaphragm 28 to the rest position. The movement of the diaphragm 28 causes an air movement 26 in the vicinity of the diaphragm 28. This air movement 26, when the diaphragm 28 is placed in close proximity to a flame 18 of a lighted wick lamp 20, causes the flame to be extinguished.

Figure 2:
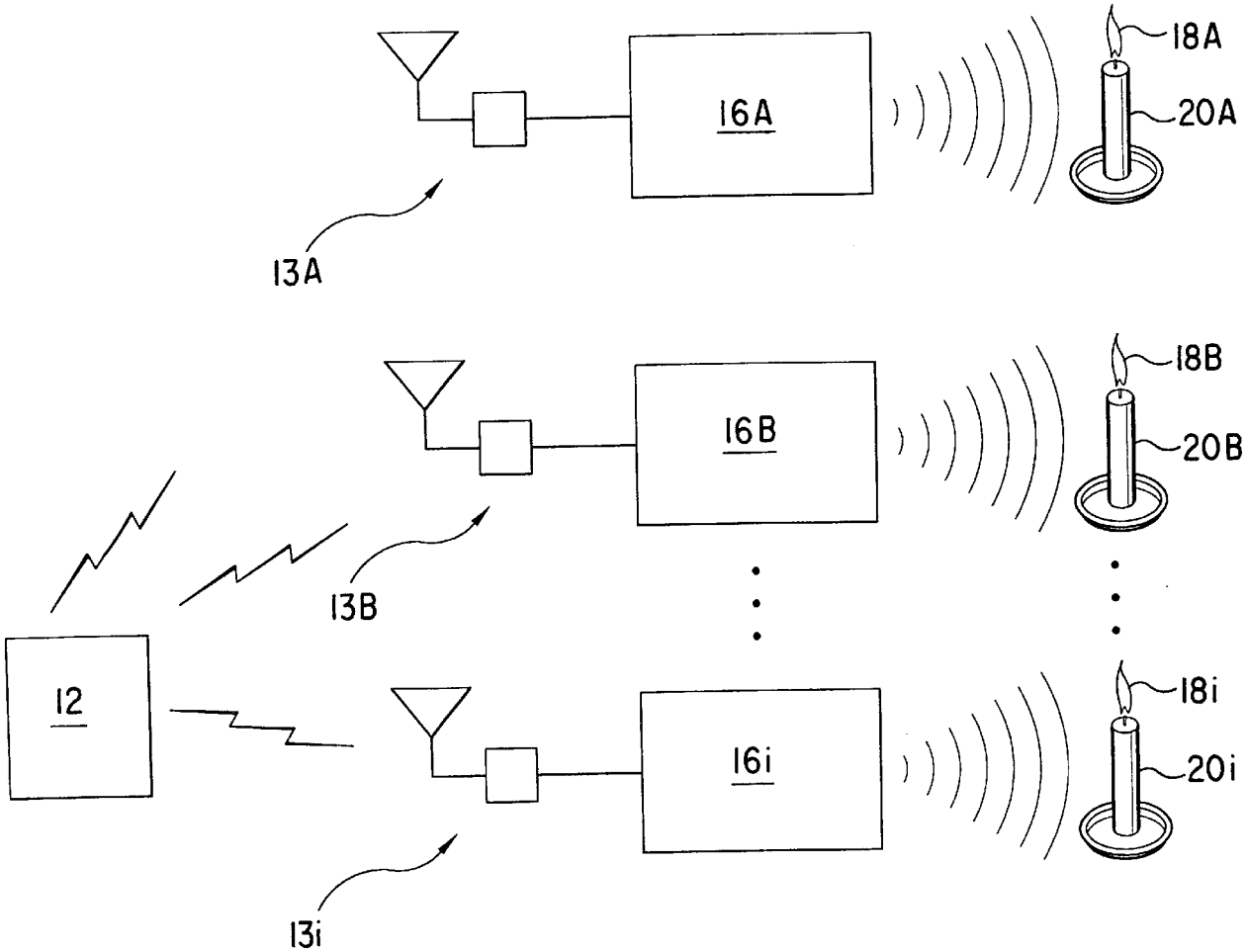
FIG. 2 is an environmental view of the preferred embodiment having multiple extinguishers.

FIG. 2 illustrates a single transmitting device 12 actuating a plurality of transducers 16A, 16B, - - - 16*i*. The transmitting device 12 communicates, either selectively of simultaneously, with each receiver device 13A, 13B, - - - 13*i* as discussed above in FIG. 1. Each of transducer 16A, 16B, - - - 16*i* is respectively associated with a lighted wick lamp 20A, 20B, - - - 20*i* for extinguishing the respective flame 18A, 18B, - - - 18*i* thereof. It is conventional in the art that "i" equals any number, so that the plurality of receivers and transducers are individually represented as shown.

It understood that the specific elements of the transmitting device 12, the receiving antenna 22, the receiver/converter 14A, the tone generator 14B, and the timing circuit 14C and transducer 16 are conventionally known to those skilled in the art. Thus, the specific recitation of each circuit component and the cooperation of each element is not necessary.

It is to be understood that the present invention is not limited to the sole embodiment described above, but encompasses any and all embodiments within the scope of the following claims.

I claim:

1. A remote lighted wick extinguisher for extinguishing a flame of a lighted wick comprising:

means for transmitting energy;

means for remotely receiving said energy;

means, coupled to said means for remotely receiving, responsive to said energy for generating an electrical pulse; and a transducer responsive to said electrical pulse, said transducer producing a single pulse of air movement;

wherein, said transducer being disposed in close proximity to the flame of the lighted wick, said air movement extinguishes the flame.

2. The remote lighted wick extinguisher according to claim 1, said means for generating an electrical pulse including a mono-stable multivibrator.

3. The remote lighted wick extinguisher according to claim 1, said means for remotely receiving said energy including an antenna.

4. The remote lighted wick extinguisher according to claim 1, said means for remotely receiving said energy including an optical detector.

5. The remote lighted wick extinguisher according to claim 1, said means for remotely receiving said energy including an acoustical detector.

6. The remote lighted wick extinguisher according to claim 1, said means for generating an electrical pulse including a tone generator.

7. The remote lighted wick extinguisher according to claim 6, said tone generator producing a sound of a burst of air.

8. The remote lighted wick extinguisher according to claim 1, said means for generating an electrical pulse including a timing circuit for automatically extinguishing the lighted wick after a predetermined amount of time.

9. The remote lighted wick extinguisher according to claim 1, said means for generating an electrical pulse including a mono-stable multivibrator and a tone generator;

wherein said means for generating extinguishes a lighted flame and simultaneously produces an audible sound of a burst of air.

* * * * *